US007084822B2

(12) United States Patent
Downs et al.

(10) Patent No.: US 7,084,822 B2
(45) Date of Patent: Aug. 1, 2006

(54) DUAL FEED COMMON RADIATOR ANTENNA SYSTEM AND METHOD FOR BROADCASTING ANALOG AND DIGITAL SIGNALS

(75) Inventors: Henry Downs, Portland, ME (US); Jeffrey Brown, Windham, ME (US); John Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 260 days.

(21) Appl. No.: 10/670,312

(22) Filed: Sep. 26, 2003

(65) Prior Publication Data

US 2005/0068244 A1 Mar. 31, 2005

(51) Int. Cl.
*H01Q 21/26* (2006.01)

(52) U.S. Cl. ..... 343/731; 343/799; 343/891

(58) Field of Classification Search ..... 343/731, 343/796–800, 890–893
See application file for complete search history.

(56) References Cited

U.S. PATENT DOCUMENTS 5,949,793 A * 9/1999 Bossard et al. ..... 370/487
6,677,916 B1 * 1/2004 Skalina et al. ..... 343/890
6,768,473 B1 * 7/2004 Harland et al. ..... 343/890

* cited by examiner

*Primary Examiner*—Michael C. Wimer
(74) *Attorney, Agent, or Firm*—Baker & Hostetler LLP

(57) ABSTRACT

A system and method is provided for transmitting analog and digital signals using a single traveling wave structure with radiators attached thereto, to form broadside radiation of the digital and analog signals.

21 Claims, 6 Drawing Sheets

DUAL FEED COMMON RADIATOR ANTENNA SYSTEM AND METHOD FOR BROADCASTING ANALOG AND DIGITAL SIGNALS

FIELD OF THE INVENTION

The present invention relates generally to a broadcast antenna system. More particularly, the present invention relates to a hybrid analog-digital broadcast antenna system.

BACKGROUND OF THE INVENTION

With the advent of digital radio the FCC has mandated In Band-on-Channel (IBOC) which is a hybrid analog-digital transmission system mode. FM stations in the U.S., based on the IBOC requirements, will be able to simultaneously broadcast FM-based analog and digital signals within their current allocated frequency range. Due to current FCC regulations, DA 03-831, OMB Control No. 3060-1034, issued Mar. 20, 2003, IBOC systems, separate antenna elements for analog and digital signal transmission is not permitted. Broadcast stations must use a dual input antenna that combines both the analog and digital signals within the same frequency channel while maintaining isolation between the signals.

The only current published solution to this requirement is discussed in the IEEE Broadcast Technology Society-Digital Radio Tutorial, published Oct. 9, 2002, the contents of which are incorporated herein by reference in its entirety. The IEEE dual-input antenna is conceded as generally being an expensive solution for small markets or sites that are not multiplexed.

Accordingly, a new system or method for transmitting iBiquity IBOC signals using a single antenna system is desired in the broadcast community.

SUMMARY OF THE INVENTION

The foregoing needs are met, to a great extent, by the present invention, wherein difficulties in the prior art are mitigated at least to some extent by an antenna system formed using ¼λ separated tilted radiator pairs to exploit traveling wave principles to broadcast analog and digital signals.

In accordance with one embodiment of the present invention, a traveling wave radiating aperture, is provided comprising, a substantially vertical support structure, a conducting interior structure within the support structure, having a first and second end, a plurality of vertically arranged pairs of radiating elements, circumferentially connected to the support structure, wherein the pairs of radiating elements are of substantially opposite orientation with respect to each other and on substantially opposing sides of the support structure, each pair or radiating elements being azimuthally shifted 90° from a neighboring pair of radiating elements and positioned approximately a distance of one quarter wavelength of a nominal frequency from the neighboring pair of radiating elements, and radiating elements-to-interior structure couplers, capable of transferring a digital energy signal input from the first end of the interior structure to pairs of the vertically arranged radiating elements and capable of transferring an analog energy signal input from the second end of the interior structure to pairs of the vertically arranged radiating elements.

In accordance with another embodiment of the present invention, a traveling wave radiating aperture is provided, comprising a substantially vertical support structure with a first and second end, substantially horizontal support members connected at one end to the support structure, pairs of vertically arranged radiating elements connected to another end of the respective support members, and transmission lines feeding the radiating elements, wherein digital energy input from the first end side of the vertical support structure is radiated by the radiating elements and analog energy input from the second end side of the vertical support structure is radiated by the same radiating elements, wherein each radiating element of the pairs of radiating elements is of substantially an opposite orientation with respect to each other, each pair of radiating elements being shifted 90° from a neighboring pair of vertically arranged radiating elements and positioned approximately a distance of one quarter wavelength of a nominal frequency from the neighboring pair of vertically arranged radiating elements, wherein sets of two pairs of radiating elements are formed each set being approximately positioned one wavelength of the nominal frequency from another set.

In accordance with yet another embodiment of the present invention, a traveling wave radiating aperture system is provided, comprising a substantially vertical support structure, an interior transmission line structure within the support structure, having a first and second end, pairs of vertically arranged radiating elements, circumferentially connected to the support structure, radiating elements-to-interior structure couplers, cable of transferring a digital energy signal input from the first end of the interior transmission line structure to pairs of the vertically arranged radiating elements and capable of transferring an analog energy signal input from the second end of the interior transmission line structure to pairs of the vertically arranged radiating elements, a digital signal transmitter, and an analog signal transmitter, wherein the pairs of radiating elements are of substantially opposite orientation with respect to each other and on substantially opposing sides of the support structure, each pair or radiating elements being azimuthally shifted 90° from a neighboring vertically arranged pair of radiating elements and positioned approximately a distance of one quarter wavelength of a nominal frequency from the neighboring vertically arranged pair of radiating element.

In accordance with another embodiment of the present invention, a traveling wave radiating structure is provided, comprising a vertical supporting means, a traveling wave radiating means formed by an omni directional radiating means attached to the supporting means and a energy transmitting means within the supporting means, digital signal generating means, and analog signal generating means, wherein a digital signal from the digital signal generating means is input to a first side of the supporting means and an analog signal form the analog signal generating means is input to a second side of the supporting means, via the energy transmitting means respectively, and are radiated by the omni directional radiating means.

In accordance with another embodiment of the present invention, a system for transmitting hybrid analog digital signals is provided, comprising, means for generating an analog signal, means for generating a digital signal, means for conveying the analog onto a side of a traveling wave structure, means for conveying the digital signal onto another side of the traveling wave structure, and means for radiating the analog signal and the digital signal via orthogonal radiators on the traveling wave structure to form an omni-directional radiation pattern.

A method for transmitting hybrid analog-digital signals comprising the steps of generating an analog signal, generating a digital signal, conveying the analog signal onto a side of a traveling wave structure, conveying the digital signal onto another side of the traveling wave structure, and rating the analog signal and the digital signal via orthogonal radiators on the traveling wave structure to form an omni-directional radiation pattern.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
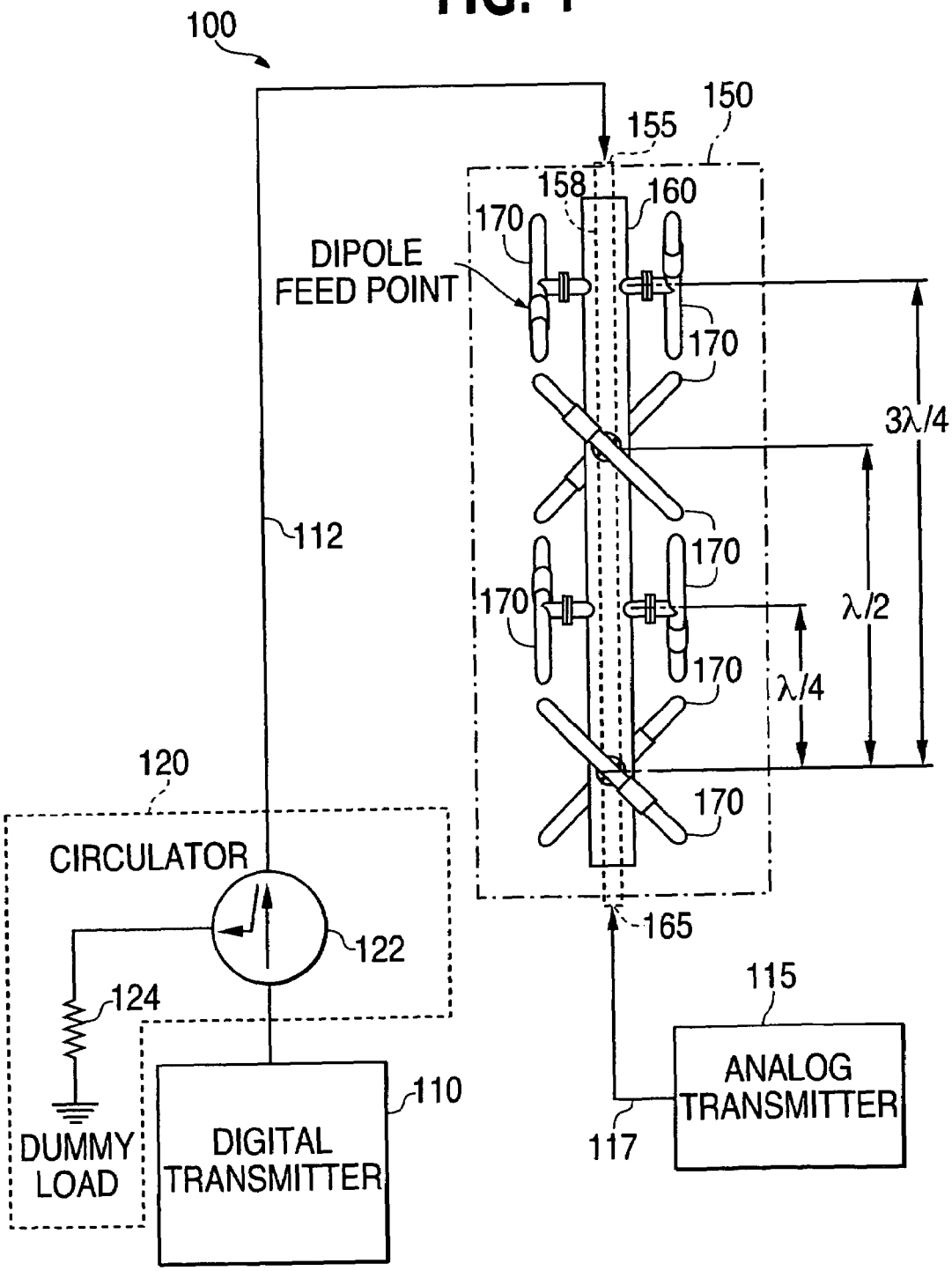
FIG. 1 illustrates an exemplary antenna system 100 according to a preferred exemplary embodiment of the invention.

Preferred embodiments of the invention will now be described with reference to the drawing figures in which like reference markers refer to like parts throughout.

FIG. 1 is an illustration of an exemplary analog-digital antenna system 100 according to a preferred embodiment of the invention. The antenna system 100 contains a digital transmitter 110 that transmits a digital signal onto the transmission line load (e.g., antenna 150). An isolator 120 is interposed between the transmission line 112 and the digital transmitter 110 to isolate the digital transmitter 110 from reflections or mismatches of power from the transmission line 112. The isolator 120 is illustrated as being composed of a circulator 122 and a terminating dummy load 124 to absorb the reflected power from the transmission line 112. Other known or future configurations for isolating the digital transmitter 110, other than the illustrated circulator 122 and dummy load 124 combination may be used, as deemed appropriate.

The digital signal transmitted from the digital transmitter 110 is fed into the exemplary antenna 150 via an input feed point 155 at the "top" of an inner conductor 158 that traverses the length of the antenna mast 160. the antenna mast 160 may be formed of a conductive or non-conductive material as desired. Circumferentially and vertically situated about the antenna mast 160 are pairs of radiators tilted with respect to each other. The pairs of the radiators 170 are tilted to form orthogonal radiating elements. Pairs of the radiators 170, aligned along the vertical axis of the antenna mast 160, are azmuthally rotated 90° with respect to neighboring radiators 170. Neighboring pairs of radiators 170 are separated along the vertical axis by a distance of approximately one half wavelength of the nominal operating frequency. Every radiator is parallel to and coplanar with another radiator in a second neighboring radiator to form a vertical plane pair.

The exemplary antenna array 150 of FIG. 1 contains four pairs of radiators capacitively or directly coupled to the inner conductor 158 of the antenna mast 160. All of the radiators 170 are similar with the exception of their respective slant and feed orientation, and all the accompanying couplers or excitation probes are of the same size.

In operation, the analog signal component of the analog-digital antenna system 100 is provided by the analog transmitter 115. The analog signal is conveyed to the antenna 150 via a transmission line 117. The analog signal enters the antenna 150 at an input feed point 165 at the "bottom" of the antenna mast 160, and connects to the inner conductor 158 that traverses the length of the antenna mast 160. A digital signal component of the antenna system 100 is provided by the digital transmitter 110. The digital signal is conveyed to the antenna 150 via a transmission line 112. The digital signal enters the antenna 150 at an input feed point 155 at the "top" of the antenna mast 160.

By combining the digital signal and the analog signal at opposite ends of the antenna mast 160, and utilizing tilted radiator pairs 170 separated by one quarter wavelength intervals, uniformly attenuated traveling waves are produced through the antenna 150 and radiated via the tilted radiators 170. To obtain an omni-directional antenna pattern, the radiator pairs 170 are configured as matched radiators which are shifted around the periphery of the antenna mast 160 to form a spiral, and are orientated and fed in a manner to cause all the radiators 170 in a vertical plane pair to generate in-phase radiation.

In a standard traveling wave antenna, the input signal attenuates as it moves along the antenna aperture. The exemplary antenna system 100 of FIG. 1 illustrates a case where the analog signal from the analog transmitter 115 is input into the bottom of the antenna 150 at the feed input 165. The analog signal travels upward and is attenuated out as radiation emitted by the radiators 170, until any remaining energy becomes "reverse energy" traveling through the transmission line 112 of the digital signal portion of the antenna system 100. Similarly, the digital signal from the digital transmitter 110 traveling on the transmission line 112 is injected into the top of the antenna 150 via the feed input 155. The digital signal travels down the aperture of the antenna 150 and attenuates via radiation from the radiators 170. Any remaining energy from the digital signal becomes the "reverse energy" traveling through the transmission line 117 of the analog signal portion of the antenna system 100.

A load termination to absorb reflected energy from the antenna 150 is typically placed at the ends of the antenna 150 to shunt to ground the reflected energy. However, in this exemplary embodiment of the invention, the load terminator is effectively replaced by the isolator 120 formed by the circulator 122 and dummy load 124 at the digital input side of the exemplary antenna system 100. Therefore, reverse energy originating from the analog transmitter 115, and traveling towards the digital transmitter 110 on transmission line 112, is absorbed by the isolator 120 as well as reflected energy originating from the antenna 150.

In FIG. 1, the exemplary antenna system 100 does not show an isolator or end load terminator for the analog transmitter side of the antenna system 100. This is due to the fact that, typically, the IBOC digital signal is inherently 20 dB below the corresponding analog level and, therefore, will not significantly impact the analog transmitter 115. Accordingly, isolator and/or end load termination is not needed at the output side of the analog transmitter 115. Since each radiator pair 170 has the same impedance and each radiator pair 170 resides one quarter wavelength from the next radiator pair 170, impedance cancellation occurs between each successive radiator set, thus achieving a broadband solution for both analog-digital signals.

Figure 2:
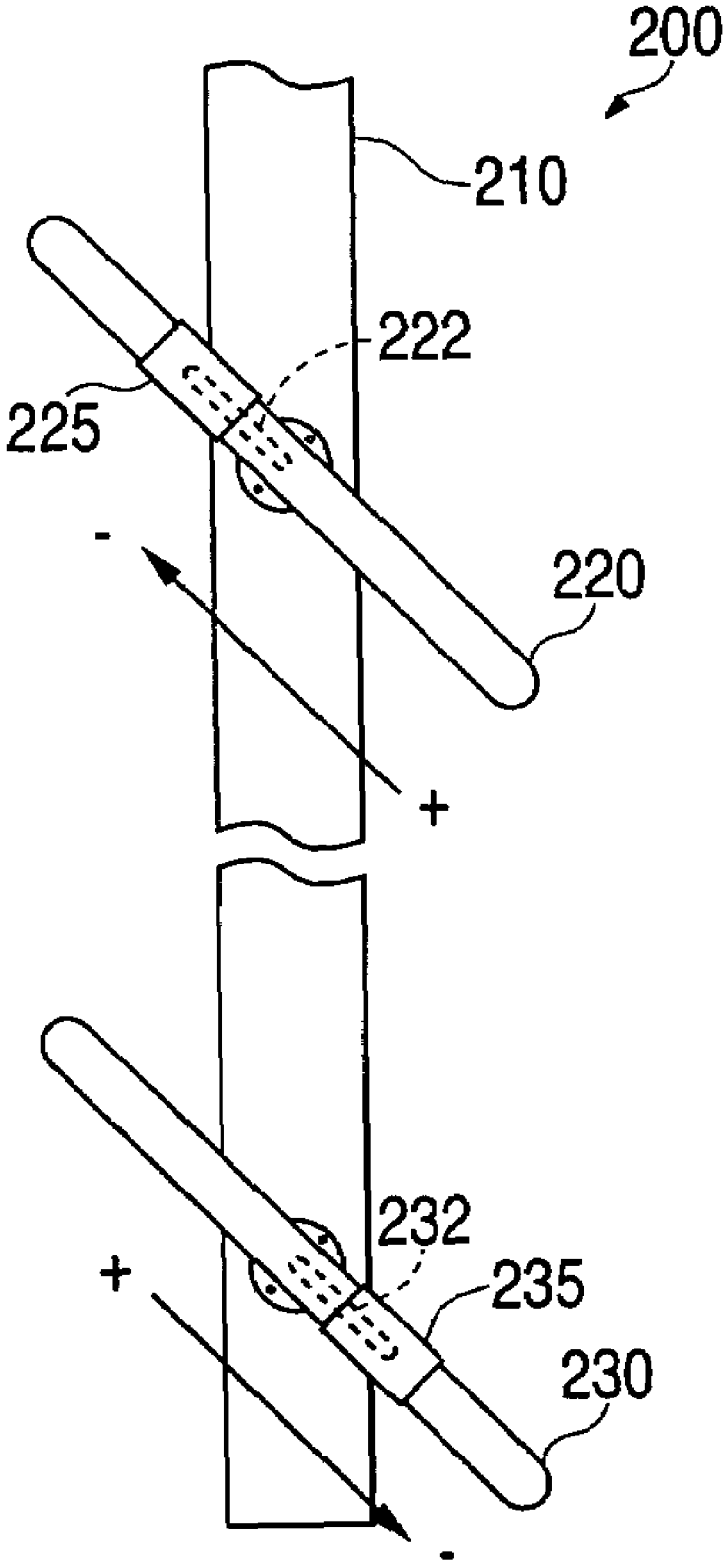
FIG. 2 illustrates a side view of a segmented portion 200 of the exemplary antenna of FIG. 1.

FIG. 2 illustrates a segmented side view 200 of the exemplary antenna of FIG. 1. An antenna mast 210 is vertically positioned having tilted radiators 220 and 230 attached thereto. The radiators 220 and 230 are orientated at a 45° angle from the axis of the antenna mast 210 and form a pair of radiators in a vertical plane. The radiators 220 and 230 represent alternating sets of radiators 170 of FIG. 1 and are parallel with each other. These radiators 220 and 230 are fed, respectively, by an internal or external transmission line 222 and 232, and "contacted," respectively, to excitation points 225 and 235. The excitation points 225 and 235 are on "opposite" ends of the center of the respective radiators 220 and 230, therefore, result in the currents generated on the radiators 220 and 230 to be in phase reversal with respect to each other. Methods for exciting radiators are well known in the art, such as, for example, capacitive coupling, probe contacts, etc., and, therefore, these and alternative methods for exciting the radiators 220 and 230 may be used without departing from the spirit and scope of this invention. In concert with the opposing excitation, the radiators 220 and 230 are separated ½λ, therefore, an omni directional pattern is provided by the configuration illustrated in FIG. 2.

Figure 3:
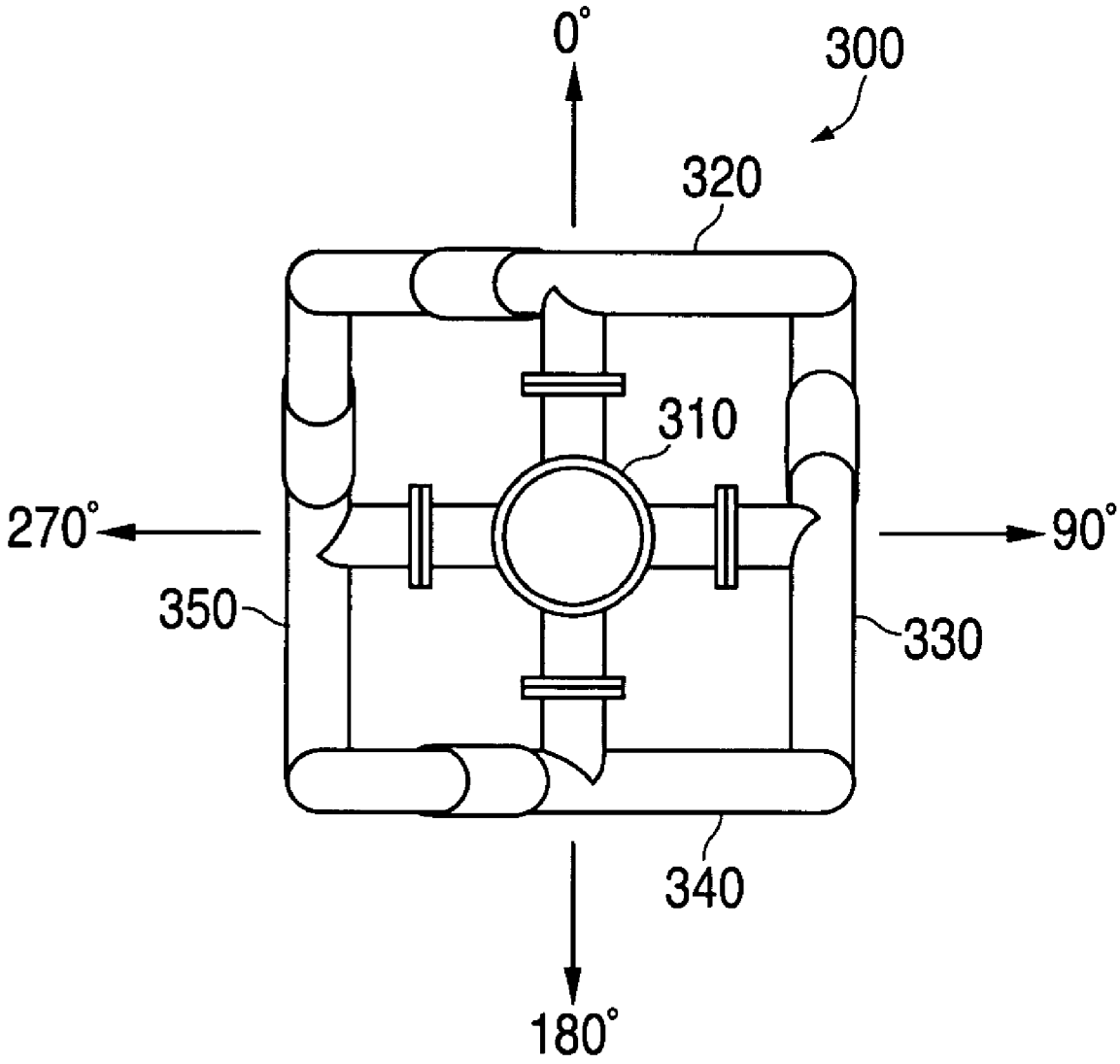
FIG. 3 illustrates a top view 300 of the exemplary antenna of FIG. 1.

FIG. 3 illustrates a top view 300 of the exemplary antenna of FIG. 1. FIG. 3 illustrates "layered" radiators 320, 330, 340, and 350 arranged circumferentially at 90° angles with respect to each other, around the antenna mast 310. The phase difference between the respective radiators 320–350 and the different layers is the same as the mutual angle difference between the layers. Therefore, the phase rotates around the periphery of the antenna mast 310 as the signal travels down/up the antenna mast 310. The rotating phase differences matched with the corresponding layer pair radiator (obstructed from view in FIG. 3) results in the desired omni directional pattern.

Figure 4:
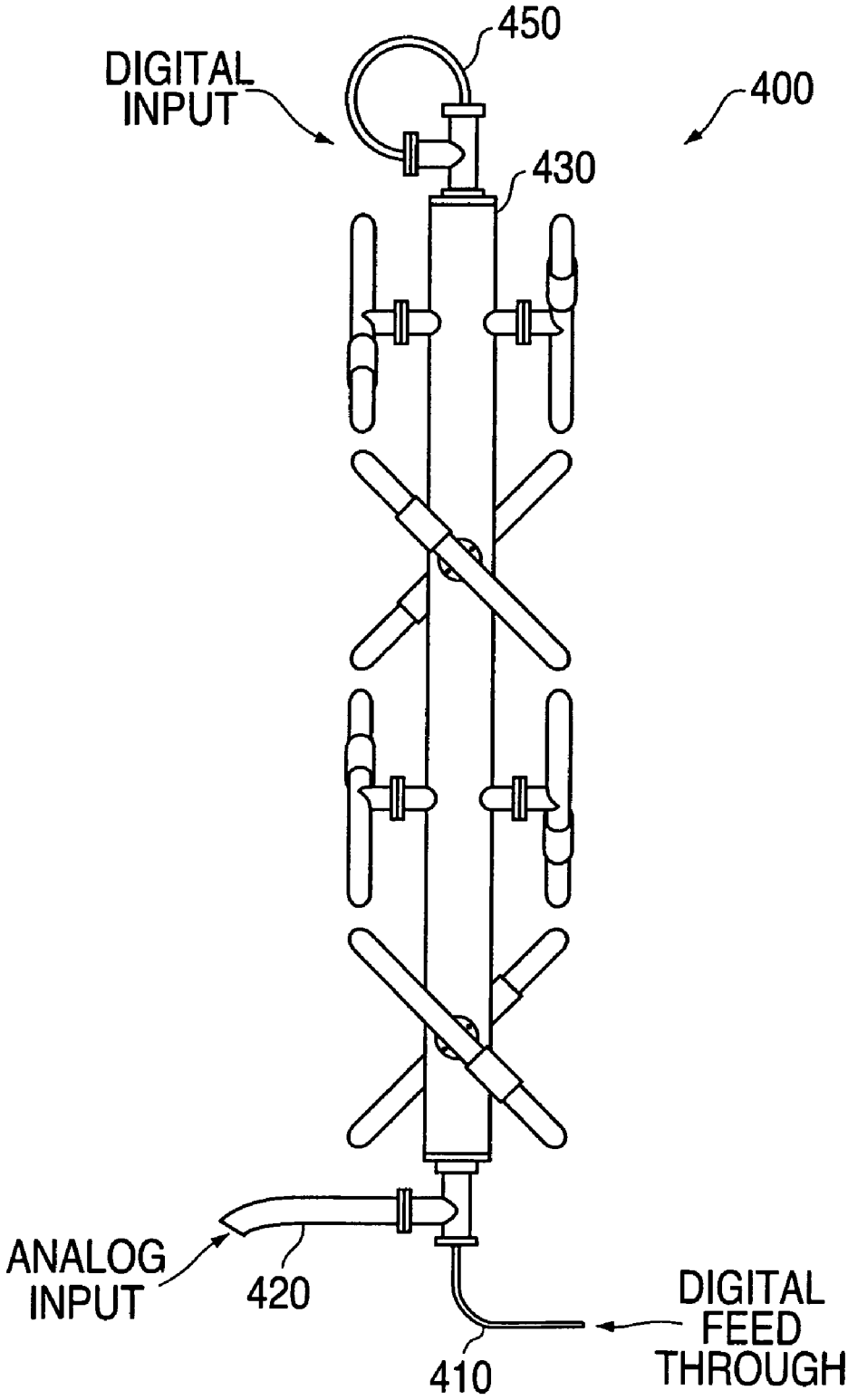
FIG. 4 illustrates an exemplary feed approach 400 for an exemplary antenna.

FIG. 4 illustrates an exemplary feed system for the exemplary antenna array 400. The exemplary feed system is "a single-entry" system for feeding the analog input 420 and digital input 410 into a common portion of the antenna mast 430. Since a digital signal is inherently of lower power than the analog signal, the transmission line carrying the digital signal can tend to be smaller than the transmission line carrying the analog signal. Therefore, while the analog input side 420 enters the "bottom" end of the antenna array 400, the digital input 410 can be fed through the center of the antenna mast 430 and brought back out at the top of the antenna mast 430 via a loop 450 to feed the antenna array 400 from the "top" side.

While FIG. 4 illustrates the analog 420 and digital input 410 entering the "bottom" of the antenna mast 430, it is readily apparent that the entry points of the antenna mast 430 may be reversed, as desired. Therefore, the use of "top" and "bottom" may be reversed according to design preference. Additionally, the antenna system 400 may be modified to have the analog input 420 pass all the way through the antenna mast 430 and be similarly brought back out of the top of the antenna mast 430 and fed into the antenna system 400 from the top side. Variations to feeding the antenna system 400 with a "single-entry" paradigm are within the purview of one of ordinary skill in the art and, therefore, are not further discussed.

FIG. 4 illustrates an exemplary feed system for the exemplary antenna array 400. The exemplary feed system is "a single-entry" system for feeding the analog input 420 and digital input 410 into a common portion of the antenna mast 430. Since a digital signal is inherently of lower power than the analog signal, the transmission line carrying the digital signal can tend to be smaller than the transmission line carrying the analog signal. Therefore, while the analog input side 420 enters the "bottom" end of the antenna array 400, the digital input 410 can be fed through the center of the antenna mast 430 and brought back out at the top of the antenna mast 430 via a loop 450 to feed the antenna array 400 from the "top" side.

While FIG. 4 illustrates the analog 420 and digital input 410 entering the "bottom" of the antenna mast 430, it is readily apparent that the entry points of the antenna mast 430 may be reversed, as desired. Therefore, the use of "top" and "bottom" may be reversed according to design preference. Additionally, the antenna system 400 may be modified to have the analog input 420 pass all the way through the antenna mast 430 and be similarly brought back out of the top of the antenna mast 430 and fed into the antenna system 400 from the top side. Variations to feeding the antenna system 400 with a "single-entry" paradigm are within the purview of one of ordinary skill in the art and, therefore, are not further discussed.

Figure 5:
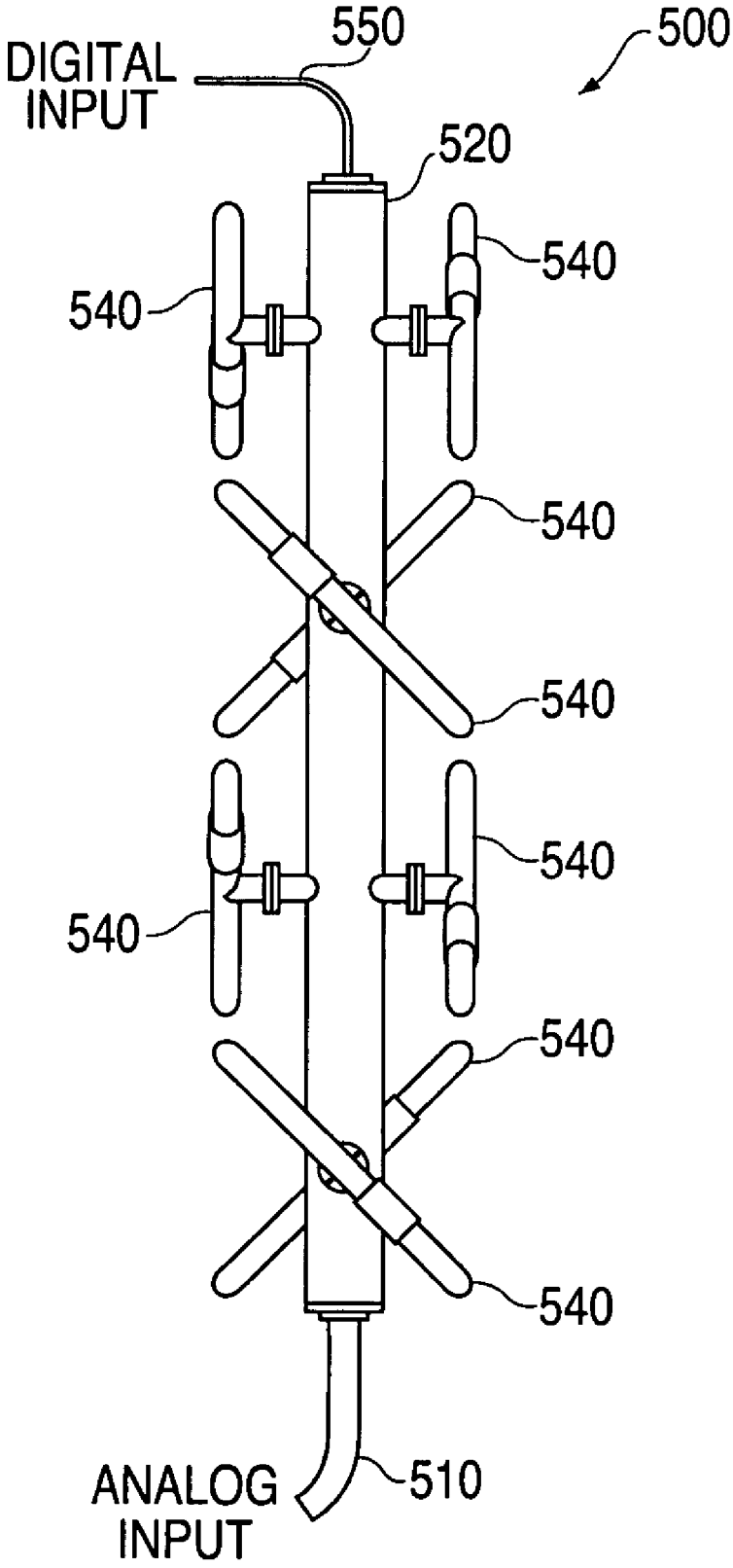
FIG. 5 illustrates an alternative exemplary feed approach 500 for an exemplary antenna.

FIG. 5 illustrates a "dual-entry" antenna system 500. The digital input signal is conveyed by line 550 is and fed independently into the top of the antenna mast 520, while the analog input signal is conveyed by line 510 and is independently fed into the bottom of the antenna mast 520. The coupling to each of the radiators 170 in the antenna array of the antenna system 500 is set such that the appropriate layer-to-layer attenuation needed to feed the radiators 540 may be realized. In addition, these coupling factors are arranged symmetrically about the center of the array and are such that the power remaining in either of the feed lines 550 or 510 after the final radiating element of the array is negligible. Therefore, the dual feed antenna system 500 may be fed simultaneously using both ends with independent digital and analog signals to broadcast simultaneously from the same radiators 540. Obviously, the digital input 550 and analog input 510 orientation may be reversed in the antenna system 500.

Figure 6:
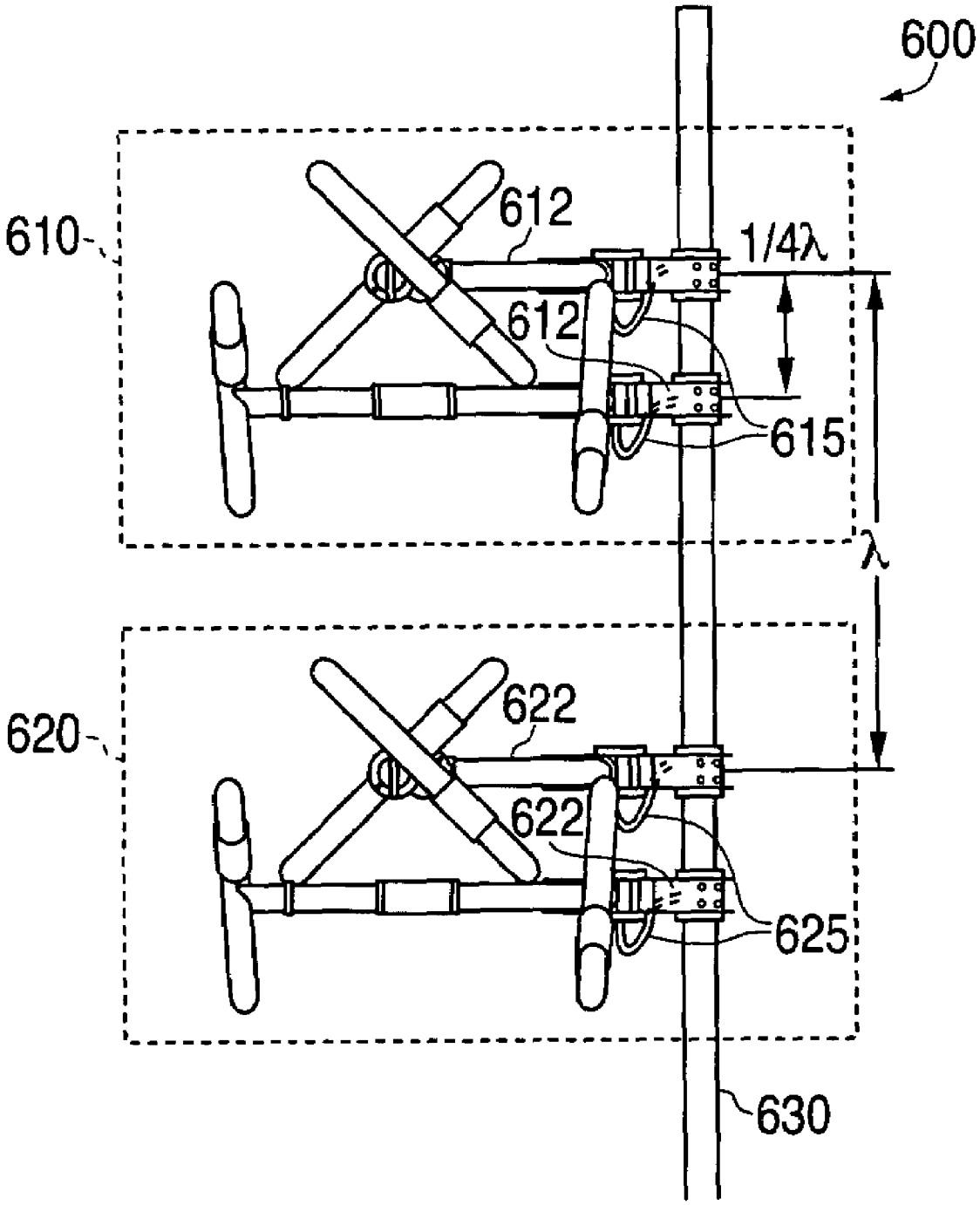
FIG. 6 illustrates a side view of an exemplary side mount array of antennas.

FIG. 6 illustrates an exemplary array 600 with radiator pairs 610 and 620 offset from an antenna mast 630 via arms 612 and 622. The configuration of the radiators 610 and 620 are similar to the configuration shown in FIG. 1. However, the antenna mast 630 and feed lines 615 and 625 are shown in FIG. 6 as being offset from the vertical axis formed by the radiators 610 and 620. The orientation of the tilted radiator in the radiator pairs 610 and 620 are maintained to preserve a 90° phase rotation. Each antenna in the array 600 is independently fed as indicated by the feed lines 615 and 625. Each of the feed lines 615 and 625 convey the fed digital and analog signals to the appropriate excitation points of the radiator pairs 610 and 620 through an inner channel of the arms 612 and 622. The feed lines 615 and 625 are illustrated as being partially exterior to the antenna mast 630 and the arms 612 and 622. However, the feed lines 615 and 625 may be completely interior to either the arms 612 and 622, and the antenna mast 630, according to design preferences.

It should be noted that each set of radiators in radiator pair 610 are separated from each other by ¼λ while the radiator pair 610 is separated from the radiator pair 620 by 1λ. In essence, the antenna array 600 illustrates a configuration with the intermediary ½λ set removed, since multiples of ½λ can be used to achieve the desired constructive interference and resulting omni directional pattern.

As is obvious from FIG. 6, alternating arrays of radiators 610 and 620 may be displaced from the antenna mast 630 at differing offset heights and/or azimuthal angles. That is, the antenna array 600 of FIG. 6 may be "mirrored" on the right hand side of the antenna mast 630. The "mirrored" antenna system may operate at different frequencies and may be fed according to any one of the systems or methods disclosed herein. Similarly, the "pairs" of radiators 610 and 620 may be mirrored at other vertical locations than that shown.

Although the above exemplary embodiments illustrate the radiators as having a "straight" configuration (e.g., dipole), alternative radiating elements such as curved dipoles or bent dipoles may be used. Therefore, other radiating elements suitable for providing the desired function may be used, such as found, for example, in the text of "Antennas" by Kraus, McGraw Hill, 1950, as well as other innumerable texts on antennas. Accordingly, the various exemplary antennas systems of this invention should not be limited to only linear dipoles, as many other types of radiators are capable of providing dipole like capabilities, as well as providing in and out-of-phase radiation.

Additionally, while the above FIGS. illustrate the exemplary embodiments as comprising a dual pair of radiators, it should be appreciated that additional radiators, individually or in sets, may be added to the antenna mast(s) or removed from the antenna mast(s) to facilitate additional or alternate frequencies or increased efficiencies acquired through superior materials or the like, without departing from the scope and spirit of this invention.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A traveling wave radiating aperture, comprising:

a substantially vertical support structure;

a conducting interior structure within the support structure, having a first and second end;

a plurality of vertically arranged pairs of radiating elements, circumferentially connected to the support structure; and radiating elements-to-interior structure couplers, capable of transferring a digital energy signal input from the first end of the interior structure to pairs of the vertically arranged radiating elements and capable of transferring an analog energy signal input from the second end of the interior structure to pairs of the vertically arranged radiating elements, wherein the pairs of radiating elements are of substantially opposite orientation with respect to each other and on substantially opposing sides of the support structure, each pair of radiating elements being azimuthally shifted 90° from a neighboring pair of radiating elements and positioned approximately a distance of one quarter wavelength of a nominal frequency from the neighboring pair of radiating elements.

2. The radiating aperture of claim 1, wherein the pairs of radiating elements are substantially oriented 45° from an axis of the support structure and are offset from each other by approximately 90°.

3. The radiating aperture of claim 1, wherein the pair of radiating elements are excited at opposite points on the radiating elements.

4. The radiating aperture of claim 1, wherein at least one of the radiating elements is a linear dipole.

5. The radiating aperture of claim 1, wherein at least one of the radiating elements is a curved dipole.

6. The radiating aperture of claim 1, wherein at least one of the radiating elements is a bent dipole.

7. A traveling wave radiating aperture, comprising:

a substantially vertical support structure with a first and second end;

a plurality of substantially horizontal support members connected at a first end thereof to the support structure;

a plurality of pairs of vertically arranged radiating elements, wherein each respective radiating element is connected to a second end of one of the respective support members; and transmission lines feeding the radiating elements, wherein digital energy input from the first end of the vertical support structure is radiated by the radiating elements and analog energy input from the second end of the vertical support structure is radiated by the same radiating elements, wherein each radiating element of the pairs of radiating elements is of substantially an opposite orientation with respect to the other, each pair of radiating elements being shifted 90° from a neighboring pair of vertically arranged radiating elements and positioned approximately a distance of one quarter wavelength of a nominal frequency from the neighboring pair of vertically arranged radiating elements, wherein sets of two pairs of radiating elements are formed, each set being positioned approximately one wavelength of the nominal frequency from another set.

8. The radiating aperture of claim 7, wherein the pairs of radiating elements are excited at opposite points of the radiating elements.

9. The radiating aperture of claim 7, wherein at least one of the radiating elements is a linear dipole.

10. The radiating aperture of claim 7, wherein at least one of the radiating elements is a curved dipole.

11. The radiating aperture of claim 7, wherein at least one of the radiating elements is a bent dipole.

12. A traveling wave radiating aperture system, comprising:

a substantially vertical support structure;

a conducting interior structure within the support structure, having a first and second end;

a plurality of vertically arranged pairs of radiating elements, circumferentially connected to the support structure;

radiating elements-to-interior structure couplers, capable of transferring a digital energy signal input from the first end of the interior structure to pairs of the vertically arranged radiating elements and capable of transferring an analog energy signal input from the second end of the interior structure to pairs of the vertically arranged radiating elements;

a digital signal transmitter; and an analog signal transmitter, wherein the pairs of radiating elements are of substantially opposite orientation with respect to each other and on substantially opposing sides of the support structure, each pair or radiating elements being azimuthally shifted 90° from a neighboring pair of radiating elements and positioned approximately a distance of one quarter wavelength of a nominal frequency from the neighboring pair of radiating elements.

13. The system according to claim 12, further comprising:

an isolator interposed between the analog transmitter and the conducting interior structure.

14. A traveling wave radiating structure comprising:

a vertical supporting means;

a traveling wave radiating means formed by an omni directional radiating means attached to the supporting means and a energy transmitting means within the supporting means;

digital signal generating means; and analog signal generating means, wherein a digital signal from the digital signal generating means is input to a first side of the supporting means and an analog signal from the analog signal generating means is input to a second side of the supporting means, via the energy transmitting means respectively, and are radiated by the omni directional radiating means.

15. A system for transmitting hybrid analog-digital signals comprising:

means for generating an analog signal;

means for generating a digital signal;

means for conveying the analog signal onto a side of a traveling wave structure;

means for conveying the digital signal onto another side of the traveling wave structure; and means for radiating the analog signal and the digital signal via orthogonal radiators on the traveling wave structure to form an omni-directional radiation pattern.

16. A system according to claim 15, wherein the conveying of the digital signal is simultaneous with the radiating of the analog signal.

17. A method for transmitting hybrid analog-digital signals comprising the steps of:

generating an analog signal;

generating a digital signal;

conveying the analog signal onto a side of a traveling wave structure;

conveying the digital signal onto another side of the traveling wave structure; and radiating the analog signal and the digital signal via orthogonal radiators on the traveling wave structure to form an omni-directional radiation pattern.

18. The method according to claim 17, wherein the step of conveying the digital signals is simultaneous with the step of radiating the analog signal.

19. The method according to claim 17, wherein the radiation pattern is not omni-directional.

20. The method according to claim 17, further comprising the step of:

attenuating the analog signal that is not radiated by the radiators.

21. The method according to claim 17, wherein the radiators are not orthogonal.

* * * * *